United States Patent [19]

Liao

[11] Patent Number: 4,508,340

[45] Date of Patent: Apr. 2, 1985

[54] BATTING AID WITH PIVOTALLY SUPPORTED BALL

[76] Inventor: Leon Liao, No. 85-3, Yu Min St., Changhwa City, Taiwan

[21] Appl. No.: 629,589

[22] Filed: Jul. 11, 1984

[51] Int. Cl.[3] ..... A63B 69/40

[52] U.S. Cl. ..... 273/26 E; 273/29 A; 273/200 B; 273/197 A

[58] Field of Search ..... 273/26 R, 29 A, 184 B, 273/186 R, 196, 197 R, 197 A, 26 E, 185 D, 200 R, 200 B, 197 A

[56] References Cited

U.S. PATENT DOCUMENTS

| | | | |
|---|---|---|---|
| 3,924,853 | 12/1975 | Schlegger | 273/29 A |
| 4,089,521 | 7/1978 | Berst et al. | 273/29 A |
| 4,417,730 | 11/1983 | Weiner | 273/29 A |

*Primary Examiner*—Richard C. Pinkham
*Assistant Examiner*—T. Brown
*Attorney, Agent, or Firm*—Harding, Earley, Follmer & Frailey

[57] ABSTRACT

A batting aid having a sandbag with a vertically adjustable support on its upper surface. The top of the support has a seat member with a slot in which a disc is mounted for pivotal movement about a horizontal axis. Pivoting of the disc in one direction is limited by an adjustable braking member. An inverted L-shaped rod is fastened to the top of the disc. The short arm of the rod is threadedly connected to one end of a housing, and a ball is secured to the other end of the housing. A vertically adjustable rubber stop is mounted on the sandbag in position to be hit by the long arm of the L-shaped rod when the ball is struck by a racket, bat or golf club. The rubber stop causes the disc, rod, and ball to rebound toward their original position, and the braking member completes the resetting of the ball to its original position for the next striking swing.

3 Claims, 8 Drawing Figures

BATTING AID WITH PIVOTALLY SUPPORTED BALL

BACKGROUND OF THE INVENTION

Hitting a baseball, tennis ball or a golf ball is a difficult art. Therefore, the more practice a golfer gets at hitting a ball, the better his hitting skills and techniques should become.

Accordingly, it is an object of the present invention to provide a batting aid whereby the user may practice the skill and techniques of hitting a ball with relative ease.

SUMMARY

It is the primary object of the present invention to provide a batting aid for batting practicing in baseball, golf and tennis.

It is another object of the present invention to provide a batting aid which may rebound rapidly to await for the next swing.

It is still another object of the present invention to provide a batting aid whereby the user can practice his swing on a more rapid pace.

It is still another object of the present invention to provide a batting aid having a ball member which is adjustable in height.

It is still another object of the present invention to provide a batting aid having a ball member which is rotatable.

It is a further object of the present invention to provide a batting aid which may offer a long service life.

Other objects and merits and a fuller understanding of the present invention will be obtained by those having ordinary skill in the art when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology, employed herein is for the purpose of description and not of limitation.

Figure 1:
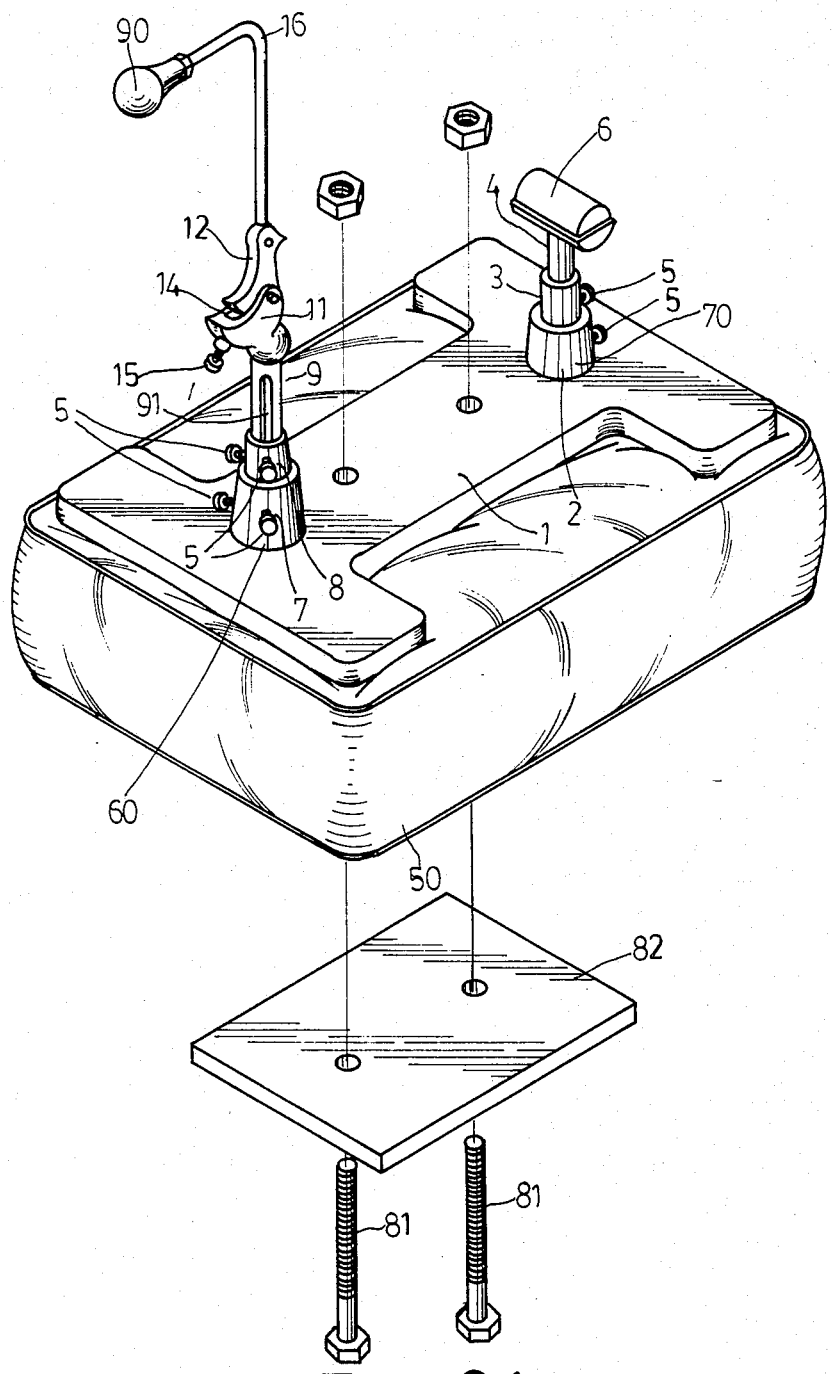
FIG. 1 is a perspective view of a batting aid embodying the present invention.

Referring first to FIG. 1, there is shown a perspective view of a batting aid embodying the present invention. As illustrated, the batting aid comprises a base member (1) and a bottom plate (82) respectively fastened on the top and the bottom of the sandbag (50) by two screws (81). On the top of the base member (1) are mounted a main support member (60) and an auxiliary support member (70). The main support member (60) includes a collar (7) which is fastened on the base member (1). A tubular member (8) is disposed within the collar (7) and retained in place by two set screws (5). A rod member (9) is supported within the tubular member (8) and fixed at any desired height by two set screws (5).

Figure 2:
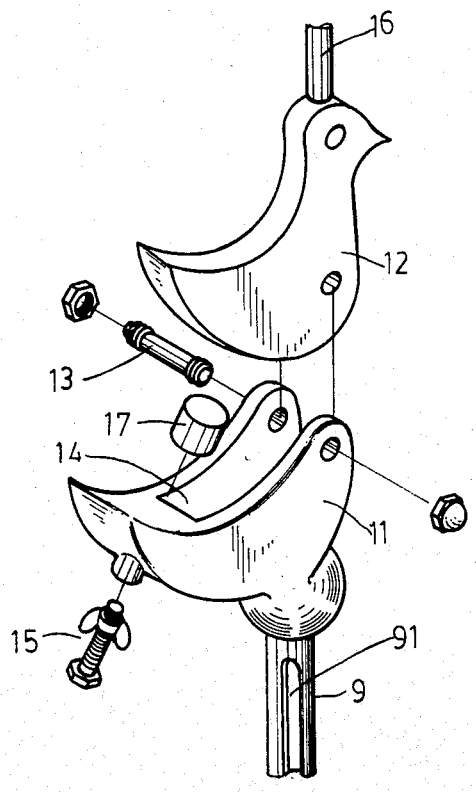
FIG. 2 is a detail view of the eccentric disc and the seat member of the batting aid.
Figure 3:
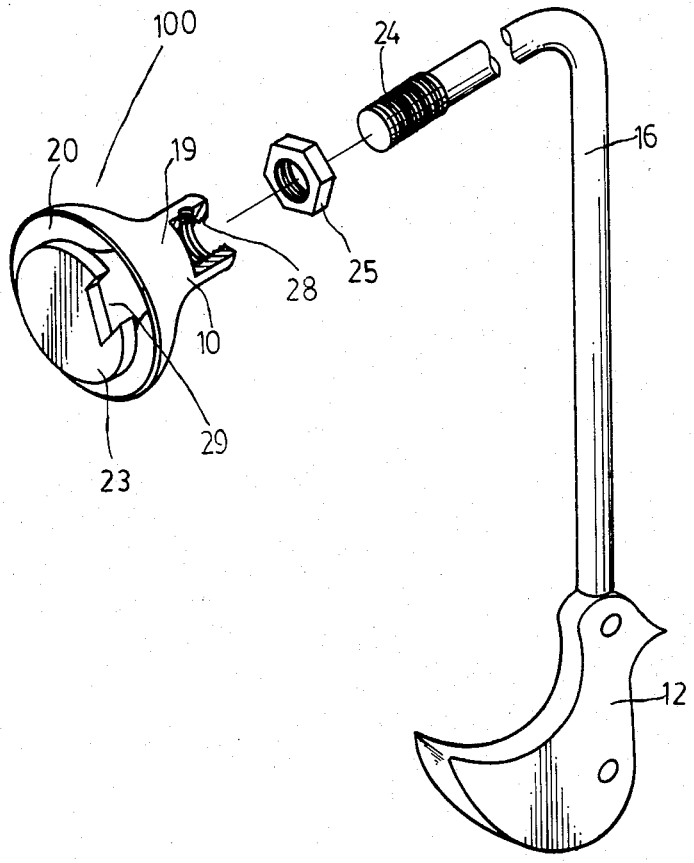
FIG. 3 shows a tennis ball fixing means of the batting aid.

As shown in FIG. 2, the rod member (9) comes with a seat member (11) having a slot (14) on which is pivoted an eccentic disc (12) by means of a pin (13). A slot (91) is provided on the length of the rod member (9) and engaged with a set screw (5). An elongated rod (16) extends from the top end of the eccentric disc (12) to form an inverted L-shaped member provided at its free end with threaded portion (24) engaged with a tennis ball fixing device (100) (as shown in FIG. 3). A breaking member (17) made of plastic or the like is attached to the end of an adjustable screw (15) threadedly engaged with the seat member (11) so as to regulate the position of the eccentric disc (12).

As seen in FIG. 3, the tennis ball fixing means (100) comprises a housing (10), threaded portion (28) provided at the end thereof, and a fixing plate (23) integrally made with the housing (10). The tennis ball fixing device (100) is engaged with the threaded portion (24) of the elongated rod (16) and secured thereto by a nut (25). Between the fixing plate (23) and the housing (10) is formed an annular space (20). The fixing plate (23) comes with a notch (29) whereby a tennis ball (17) may be secured thereto with its some part squeezed into the annular space (20).

The auxiliary support member (70) comprises a sleeve (2), a tubular member (3), a rod (4) and a highly resilient rubber member (6). The tubular member (3) is disposed within the sleeve (2) and fixed in any desired position by a set screw (5). Similarly, the rod (4) is slidably engaged within the tubular member (3) and may be secured in place by a screw (5). On the top of the rod (4) is mounted the resilient rubber member (6) which is designed so that the elongated rod (16) will spring back to its original position as soon as it hits on the resilient rubber member (6).

As the ball member (90) attached to the tennis ball fixing device (100) is struck, the arm (16) will rotate about the pin (13) to impact on the resilient rubber member (6) which will in turn spring back the ball member (90) to its original position. When the arm (16) returns to its original position, the braking member (17) will receive the resilient force of the arm (16) thereby resetting the ball member (90) to its original position for the next swing.

Figure 4:
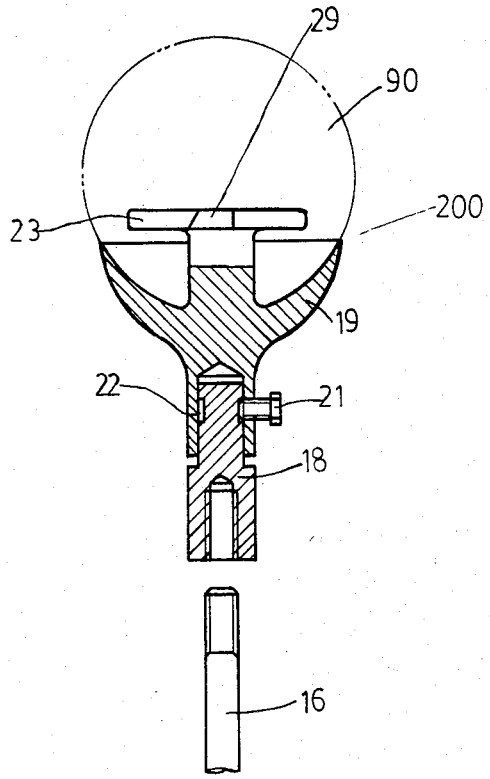
FIG. 4 shows an alternative tennis ball fixing means of the batting aid.

FIG. 4 shows an alternative tennis ball fixing means (200) of the present invention. As may be seen, the tennis ball fixing means (200) comprises a housing (19) and a connector (18). The housing (19) is provided with a fixing disc (23) having a notch (29). A annular space is formed between the fixing disc (23) and the housing (19) for receiving a ball member (90). The connector (18) is connected to the lower end of the housing (19) and is provided with an inner circumferential groove (22) for receiving a set screw (21) extending through the lower end of the housing (19). The other end of the connector (18) is threadedly engaged with the free end of the arm (16). Accordingly, the ball member (90) together with the housing (19) can be rotated about the arm (16).

Figure 5:
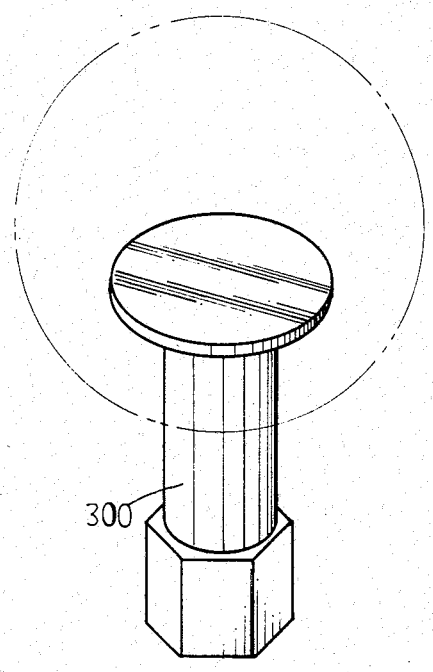
FIG. 5 shows a base ball fixing means of the batting aid.
Figure 6:
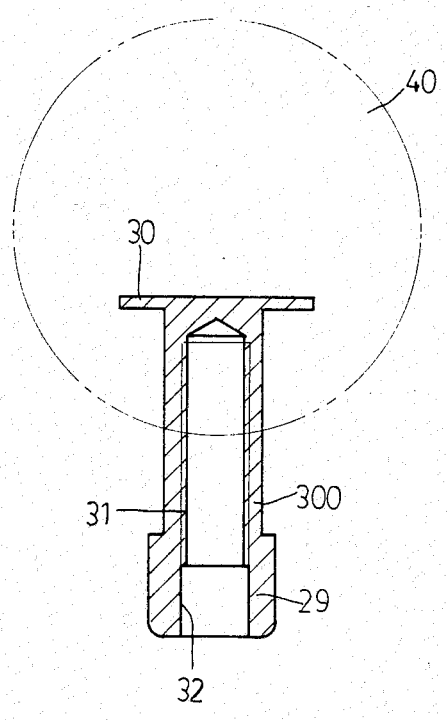
FIG. 6 is a cross-sectional view of the base ball fixing means of FIG. 5.

With reference to FIG. 5, there is shown a base ball fixing means (300) for fixing a base ball (40). The base ball fixing means (300) comprises a cylindrical body (29) which is provided with a hexagonal portion (29) at its lower end and a flange (30) on its top. The base ball fixing means (300) is formed with internal threads (31) for engaging with the elongated arm (16). A very shallow threaded portion (32) is provided below the internal threads (31) for preventing the elongated arm (16) from breaking.

Figure 7:
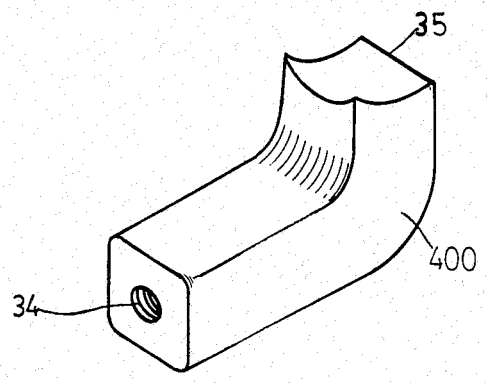
FIG. 7 shows a ball support of the batting aid.

FIG. 7 shows a ball support (400) of the batting aid. The ball support (400) is formed with internal threads (34) for connecting with the elongated arm (16) and a platform (35) on which a base ball or the like may be placed. Hence, the user may observe the flying path of the ball hitted by himself.

Figure 8:
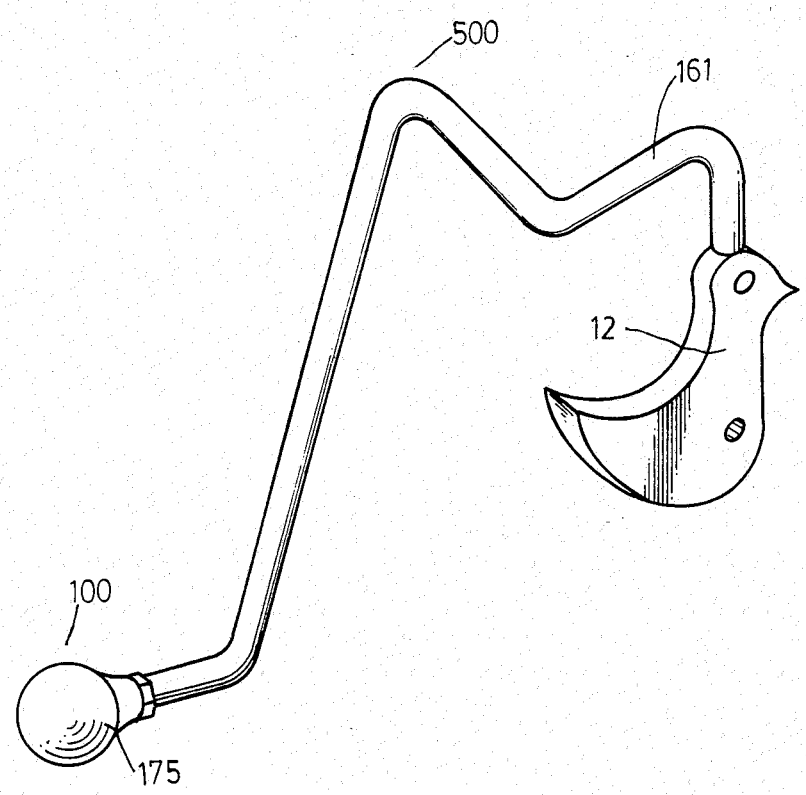
FIG. 8 shows a golf ball fixing means of the batting aid.

FIG. 8 shows a device (500) for fixing a golf ball (175). The device (500) comprises an eccentric disk (12), an arm (161) integral with the eccentric disk (12), a ball fixing means (100), and a golf ball (175) secured on the ball fixing means (100).

Although this invention has been described with a certain degree of particularly, it is understood that the present disclosure has been made by way of example only and that numerous changes in the detail of construction and the combination and arrangement of parts may be resorted to without deparitng from the spirit and scope of the invention as hereinafter claimed.

I claim:

1. A batting aid comprising:

a base member;

a main support member including a collar fastened on said base member, a tubular member disposed within said collar and fixed thereto by two set screws, a rod member disposed within said tubular member and fixed thereto by two set screws, a seat member provided on the top of said rod member, said seat member having a slot therein, an eccentric disc pivotally mounted in said slot, and an elongated rod extending from the top of said eccentric disc, said elongated rod having threaded portion at its free end;

ball fixing means threadedly engaged with said elongated rod and secured thereto by a nut, said ball fixing means having a housing, a threaded portion provided at the end thereof and a fixing plate formed integrally with the housing in a way such that an annular space is formed between the fixing plate and the housing, a ball member attached to said fixing plate of said ball fixing means in a manner that a part of said ball member is within the annular space; and an auxiliary support member including a sleeve fastened on said base member, a tubular member disposed within said sleeve, a rod disposed within said tubular member, and a resilient rubber member secured on the top of said rod.

2. A batting aid as claimed in claim 1, further comprising a sandbag on which said base member is fastened.

3. A batting aid as claimed in claim 1, further comprising a bottom plate fastened on the bottom of said sandbag.

* * * * *